United States Patent [19]

Grob

[11] 4,060,187

[45] Nov. 29, 1977

[54] PROCESS AND APPARATUS FOR PERMANENTLY CONTROLLING THE MOVEMENT OF WEB OF MATERIAL CONTINUOUSLY DELIVERED TO A MACHINE PROCESSING THE WEB

[75] Inventor: Jean Grob, Chavannes, Switzerland

[73] Assignee: J. Bobst & Fils, S.A., Switzerland

[21] Appl. No.: 745,245

[22] Filed: Nov. 26, 1976

[30] Foreign Application Priority Data

Nov. 26, 1975 Switzerland ..... 015311/75

[51] Int. Cl.[2] ..... B65H 17/22; B65H 23/26

[52] U.S. Cl. ..... 226/8; 83/236; 226/114; 226/117; 226/155; 226/177; 226/187

[58] Field of Search ..... 226/117, 113, 114, 115, 226/8, 1, 118, 119, 154, 155, 177, 187, 122; 83/236, 235

[56] References Cited

U.S. PATENT DOCUMENTS

| | | | |
|---|---|---|---|
| 2,932,508 | 4/1960 | Tennler | 226/114 |
| 3,085,457 | 4/1963 | Fischer et al. | 226/114 X |

*Primary Examiner*—Bruce H. Stoner, Jr.
*Attorney, Agent, or Firm*—Hill, Gross, Simpson, Van Santen, Steadman, Chiara & Simpson

[57] ABSTRACT

A method and apparatus for permanently controlling movement of a web of material, which is being continuously supplied to a machine which operates sequentially on a portion of the web as each portion is at a standstill, characterized by using an apparatus including a feeder for feeding the web at a continuous rate of speed and a web take-up device for engaging the web as it exits the feeder to absorb the web being supplied by the feeder for a period of time that the portion of the web is being acted on by the machine and is in a stationary position or at a standstill. The web take-up device includes a pair of members mounted in a pair of spaced side frames for rotation on a first axis, a roller engaging a portion of the web and a structure for mounting the roller on the pair of members for rotation on a second axis offset from the first axis. The structure for mounting the roller includes a control screw for varying the amount of offset of the second axis from the first axis with the improvement comprising a counterweight for equilibrating the weight of the roller and a cam and lever arrangement for varying the angular position of the second axis of the roller during rotation of the pair of members on the first axis at a rate dependent on the amount of offset between the first and second axis so that the portion of the web within the machine is at a standstill for a predetermined period of time.

10 Claims, 10 Drawing Figures

Fig. 4
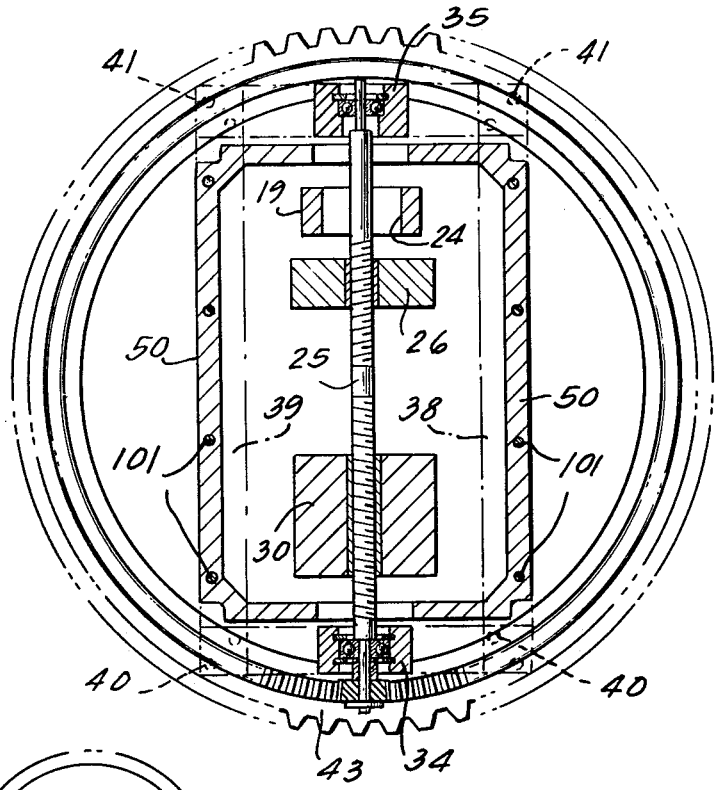
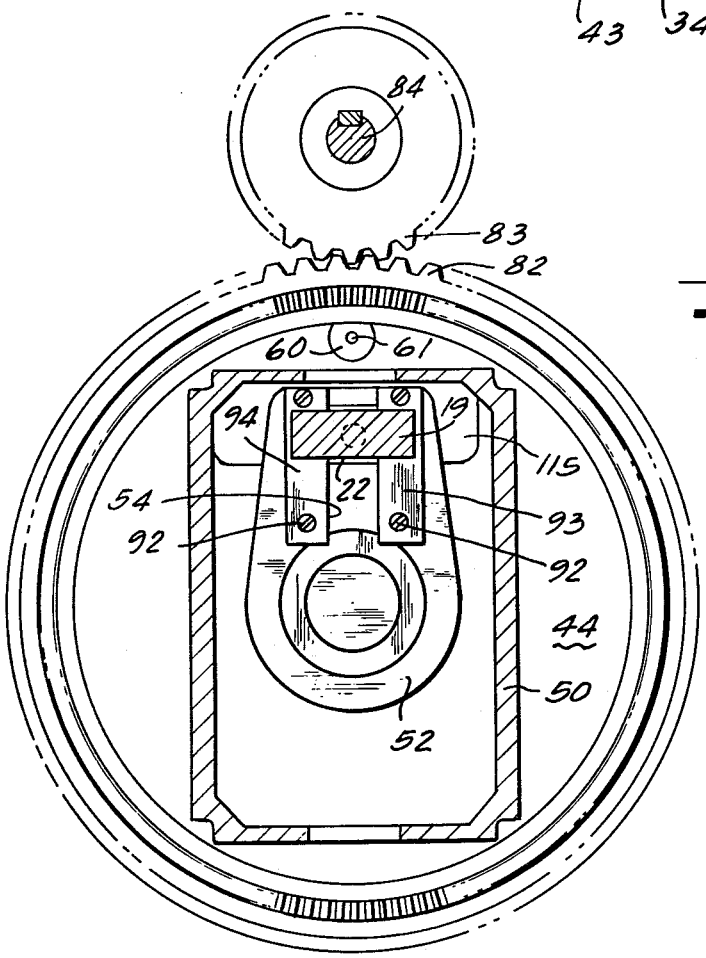
Fig. 5

IX
138
161
137
10
X
133
124
126
125
129
127
153
128
132
140
122
131
141
142
147
144
169
170
222
148
120
123
121
119
171
12
152
118
1
IX
150
11
151
X

PROCESS AND APPARATUS FOR PERMANENTLY CONTROLLING THE MOVEMENT OF WEB OF MATERIAL CONTINUOUSLY DELIVERED TO A MACHINE PROCESSING THE WEB

BACKGROUND OF THE INVENTION

1. Field of the Invention

The present invention is directed to a method and apparatus for controlling the movement of web of material being fed at a constant rate of feed through a web take-up device to a machine which acts on a portion of the web as that portion is at a standstill. The web take-up device includes a pair of members mounted in a side frame for rotation on a first axis, a roller for engaging a portion of the web, and means for mounting the roller on the pair of members for rotation on a second axis which is offset or eccentric to the first axis with the amount of offset or eccentricity being controlled by a control screw.

2. Prior Art

In one known method and apparatus for forming blanks utilizing a platen press, a web of material, for example cardboard, is generally delivered to the platen press in a continuous manner. In view of the fact that the platen press is able to die cut a portion of the web if this portion is temporarily stopped or at a standstill, continuous feeding of the web causes the web to accummulate in front of the cutting station or the platen press. To overcome this problem of accummulation of the continuously moving web, several solutions have been suggested and tried out.

The most simple solution consists of forming a loop in the web prior to its introduction into the press. However, fluttering will occur in the loop and this solution has been found to be unsatisfactory when the production speed is increased and when the accuracy of the position of the web portion introduced into the platen press must be maintained in order to obtain a registry between the printing on the web and the die cut pattern.

Machine builders, therefore, imagined a way to check the formation of the web loop in such a way that the effect of fluttering on the web would be reduced to a very minimum at a point of entry to the machine by using a loop control device. For this purpose, an appliance was used which involved the web being lead around a circumferential portion of a roller which is mounted between two rotating members or plates with the axis of the roller being offset from the axis of rotation of the plates. German Pat. No. 1,061,167 of July 6, 1957 is an example of this type of apparatus.

However, the above-mentioned solution did not bring about the necessary improvements in controlling the movement of the web and a third solution was directed to a complete and permanent web loop control device or apparatus. This apparatus generally includes an infeed and pull rollers moving the web up to an inlet of a cutting station and an appropriate appliance or device for providing an interlock on the web is arranged at the inlet of the cutting station. The web track between the pull rollers and interlocking devices is equipped with a compensator controlled by means of a cam and designed to continuously maintain the loop of the web under adequate tension. This compensator, which consists of a half cylinder on which the web slides around, is shifted by means of a lever controlled by a pull rod which is itself connected to a cam and cam lever assembly. However, since an alternative motion to actuate the compensator will put the mechanical components under a rather severe stress and strain, which are dependent on the operating speed desired, this design has many limitations. In addition, the device of the third suggested solution compulsorily requires the use of an appliance or device for interlocking the web at the moment when the platen press is actually being closed.

SUMMARY OF THE INVENTION

The present invention is directed to a method and apparatus which overcomes the above-mentioned drawbacks with the previous solutions for controlling a web being continuously introduced to a machine such as a platen press. To accomplish this task, the apparatus includes means for feeding the web at a continuous rate of feed which includes means for pulling and introducing the web of material, and a web take-up means for engaging the web of material prior to being received by the machine processing portions of the web. The web take-up means has a pair of members mounted in a pair of spaced side frames for rotation on a first axis, a roller engaging the portion of the web, and means for mounting the roller on the pair of members for rotation on a second axis offset or eccentric from the first axis. The means for mounting includes a control screw for varying the amount of offset of the second axis from the first axis with the improvement comprising means for equilibrating the weight of the roller and the means for mounting including means for varying the angular position of the second axis of the roller during rotation of the pair of members on the first axis, the means for varying changing the angular position at a rate dependent on the amount of offset between the first and second axes so that the portion of the web within the machine is at a standstill for a predetermined period of time which is required for the machine to operate on the portion due to the eccentric movement of the roller absorbing the total length of the web being supplied from the web feeding means during this predetermined period.

The method or process comprises feeding the web from the feeding device around a circumferential portion of a roller of the web take-up device and then to the machine, and includes the improvement of changing the angular position of the second axis of the roller relative to the first axis during each rotation of the take-up device and controlling the rate of change of the angular position in response to the amount of eccentricity of the second axis to the first axis so that the portion of the web within the machine is at a standstill for a predetermined period of time which is required for the machine to operate on the portion due to the eccentric movement of the roller absorbing the total length of the web being supplied from the web feeding device during this predetermined period.

The process and apparatus due to the fact that it is possible to vary the angular position of the axle or axis of the roller during the rotation, which is effected by the pair of rotating members, enables a complete stopping of the portion of the web which is within the machine for a predetermined time by absorbing the whole quantity of the web arriving onto the roller. In order to completely absorb the web, the process and apparatus also include the provision that the amount of variation of the angular position of the axis of the roller is controlled in response to amount of eccentricity of the roller with regard to the axis of rotation of the pair of members.

BRIEF DESCRIPTION OF THE DRAWINGS

FIG. 4 is a cross-sectional view with portions in elevation for purposes of illustration taken along lines IV—IV of FIG. 2;

FIG. 5 is a cross-sectional view with portions in elevation for purposes of illustration generally taken along lines V—V of FIG. 2;

DESCRIPTION OF THE PREFERRED EMBODIMENT

Figure 1:
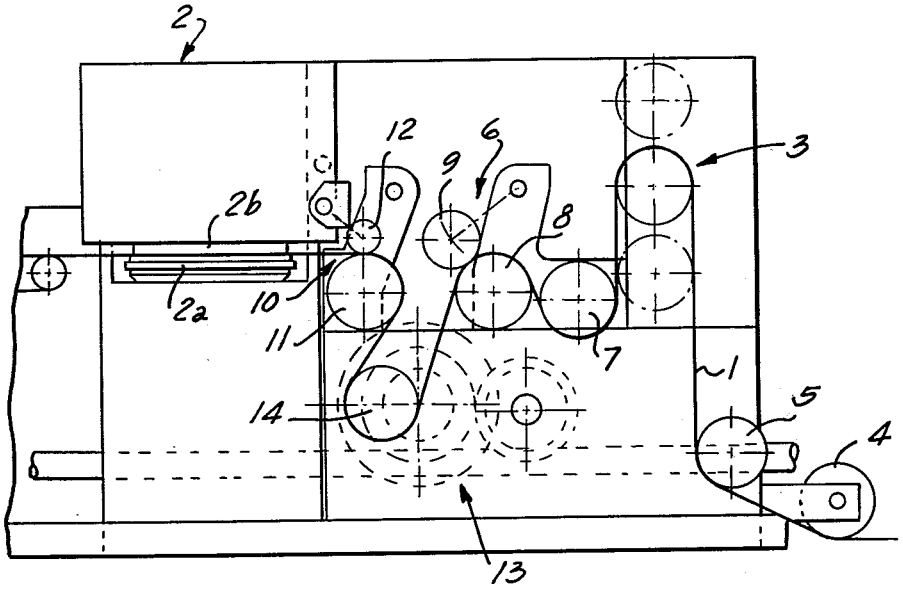
FIG. 1 is a generally schematic view of the web feeding device having a web absorption arrangement for permanently controlling the movement of the web to a machine.

The principle of the present invention is particularly useful for controlling the movement of a web of material 1 as it is being continuously fed to a platen press generally indicated at 2 in FIG. 1. The press 2 operates on a portion of the web which is disposed between a pair of platens *2a* and *2b* of the press and is held at a standstill as the platens *2a* and *2b* engage the portion to operate thereon such as to die cut a blank therefrom.

The web of material 1 originates in a preceeding station which is not illustrated and is received by rollers 4 and 5 and lead to a web compensator generally indicated at 3. From the web compensator 3, the web 1 of material is passed around an idler roll 7 to a pulling appliance generally indicated at 6. The pulling appliance 6 consists of a pull roller 8 on which the web 1 actually travels and pressure roller 9. From the pulling appliance 6, the web is continuously fed to an infeed appliance generally indicated at 10. The infeed appliance 10 consists of a lower roller 11 operating with a circumferential speed slightly higher than the maximum traveling speed of the web 1 and includes an assembly of pressure rollers 12 which are capable of being lifted upon request so that the traction exerted on the web by the driven roller 11 can be neutralized. Disposed between the pulling device 6 and the infeed appliance or device 10, is a web absorption device or web take-up means generally indicated at 13 which includes a roller 14 and absorbs or takes-up the moving web 1 during a predetermined period of time on which the portion being acted on by the platen press 2 is at a standstill to enable die cutting thereof.

Figure 2:
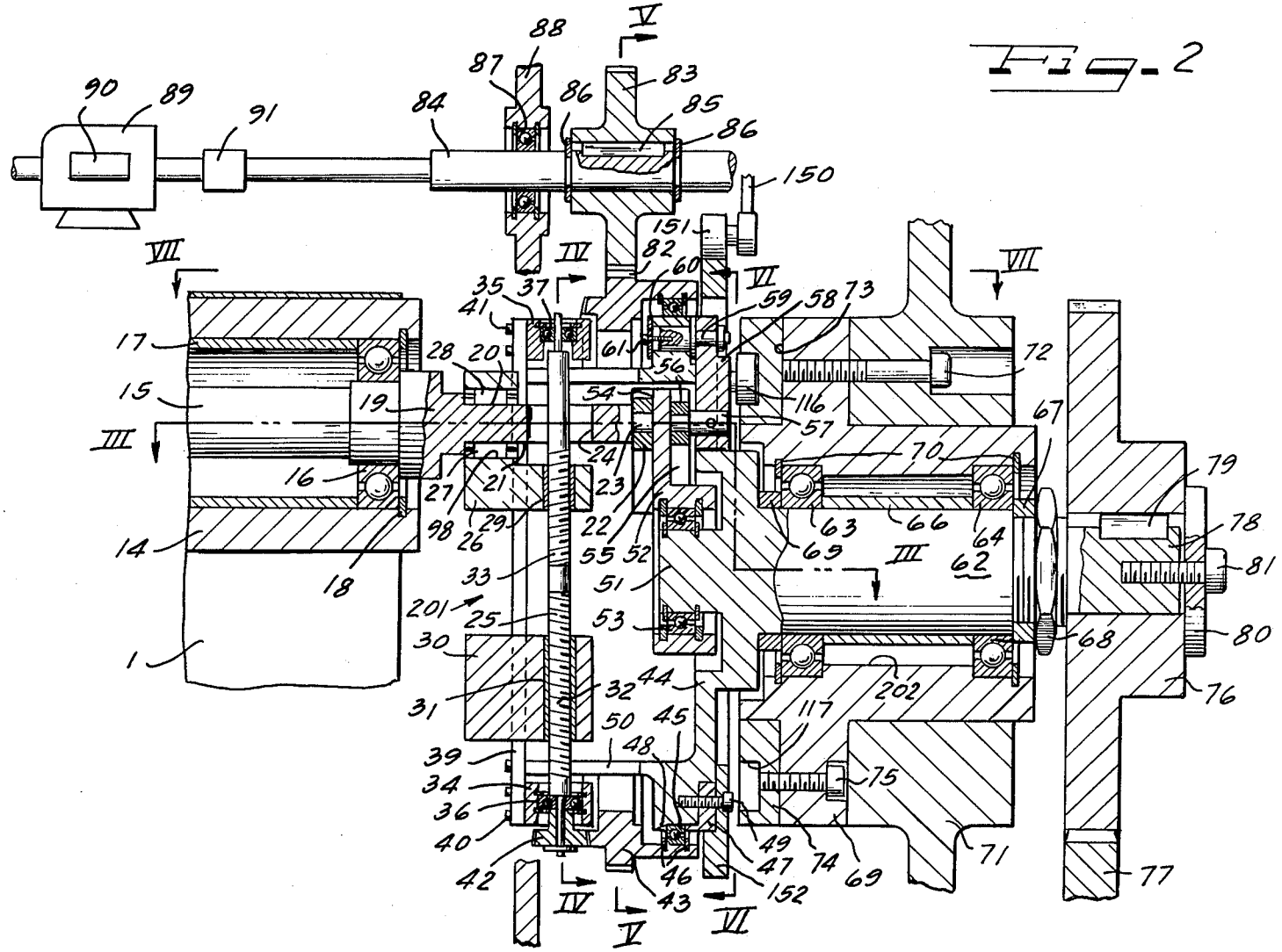
FIG. 2 is a longitudinal cross-sectional view with portions in elevation for purposes of illustration of one end of the web absorption device of FIG. 1.

The structure of the absorption device or web take-up device 13 is best illustrated in FIG. 2 in which one half such as the right hand side of the device is illustrated and it should be remembered that the left hand side is exactly the same. The web take-up device 13 comprises a pair of rotating members 44 which are mounted for rotation in side frame members such as 71, and the roller 14, which is mounted for rotation by mounting means 201 between the pair of rotating members 44.

The roller 14 is supported for rotation on an axle or shaft 15 by ball bearings 16 which are maintained in the desired position by a spacing sleeve or spacing bushing 17 and snap ring 18. The axle 15 on each end has an end portion 19 which is provided with a pair of parallel extending flat surfaces 20 and 21, an aperture 24 and a cylindrical support 23 which receive and support a square, sliding shoe 22.

To mount the end 19 of the shaft 15 for the roller 14 in the rotating member 44, the mounting means 201 include a sliding shoe support or member 26 which is provided with an elongated aperture 98 to receive the end 19 of the shaft 15. With the end 19 extending through the aperture 98, needle bearings 27 engage the surface 21 while needle bearings 28 engage the surface 20 of the portion 19. The sliding shoe support 26 can be radially shifted with respect to the axis of rotation of the rotating member 44 by a control or setting screw 25. As illustrated, the sliding shoe 26 is received on a right handed threaded portion 33 of the screw 25 by a threaded sleeve or nut 29.

In order to compensate for an unbalancing of the rotating web take-up means 13 due to a change in the radial position of the roller 14, the mounting means includes an equilibrating means comprising a counterweight 30 which is threaded by a threaded sleeve or nut 31 on a portion of left handed threads 32 of the control screw 25. Thus, movement of the control screw will symmetrically shift both the counterweight 30 and the sliding shoe 26.

Figure 3:
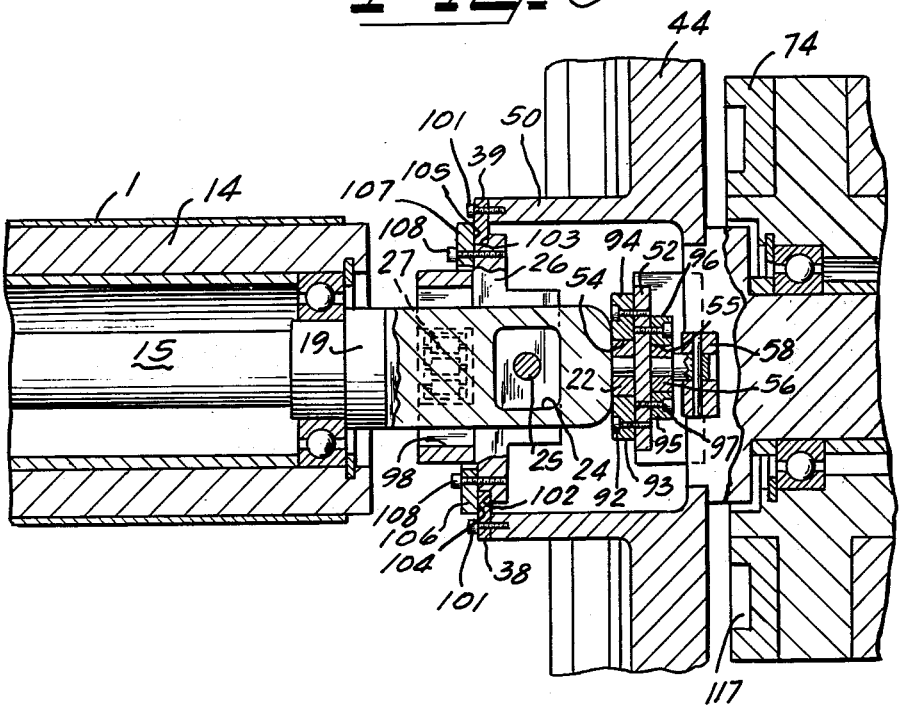
FIG. 3 is a cross-sectional view with portions in elevation for purposes of illustrated taken along lines III—III of FIG. 2.

The control screw 25 is supported at each end in supports 34 and 35 which have bearings 36 and 37 engaging the end of the screw. The support 34 is secured to guide rails 38 and 39 by threaded fasteners or screws 40 while the support 35 is secured to the guide rails 38 and 39 by threaded fasteners or screws 41 (see FIG. 4). The control screw 25 on one of its ends is provided with a tapered pinion 42 (FIG. 2) which is in mesh engagement with a rim gear 43. The gear 43 is supported on the member 44 by a ball bearing 45 which is held on the rim gear 43 by a pair of snap rings 46 and is supported on the plate or member 44 by means of a ring 47 and a shoulder 48 which is provided on member 44. As illustrated, the ring 47 is secured on the plate 44 by means of screws such as 49. The plate 44 has a frame-like axial extension 50 on which the guide rails 38 and 39 are secured such as by threaded fasteners or screws 101 (FIG. 3). As will be discussed hereinafter, the guiding rails 38 and 39 coact to hold the sliding shoe 26 and the counter weight 30 during their shifting by the control screw 25.

Figure 6:
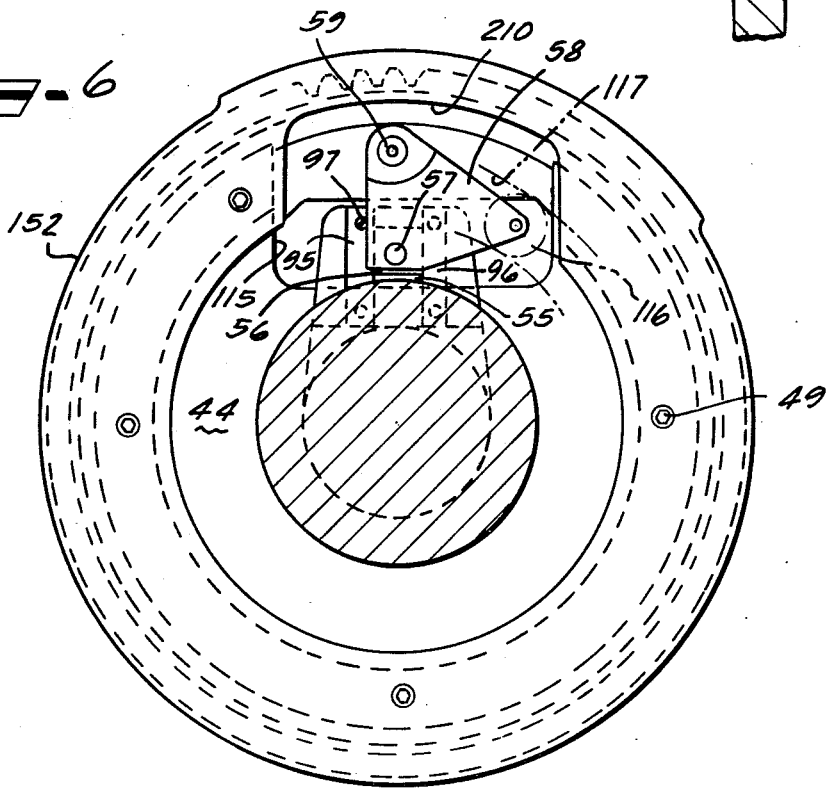
FIG. 6 is a cross-sectional view with portions in elevation for purposes of illustration generally taken along lines VI—VI of FIG. 2.

The rotating member 44 also includes a cylindrical section 51 on which a lever 52 is pivoted. As illustrated, the lever 52 is mounted for pivotable movement by a ball bearing 53 which is held on the desired axial position within the lever 52 and on the cylindrical section 51 by appropriate snap rings. As best illustrated in FIG. 5, one face of the lever 52 is provided with a sliding groove 54 which receives the sliding shoe 22 that is supported on the end 19 of the shaft 15 for the roller 14. As best illustrated in FIG. 6, the other face of the lever 52 has a sliding groove 55 which receives a sliding shoe 56 that is connected with a cam lever 58 by means of an axle 57. The cam lever 58 is mounted for pivotable movement on an axle or stud 59 which is held on the rotating member 44 by a washer 60 and screw 61. As illustrated in FIG. 6, the rotating member 44 has a cut-out portion 115 adjacent to the lever 58 to provide clearance for pivotable movement of the lever 58 and to enable the shoe 56 to be received in sliding groove 55.

To mount the rotating plate 44 in a side frame such as 71, the plate has a tail or stub 62. The stub 62 supports a pair of ball bearings 63, 64 which are retained in the desired position by spacing means comprising ring 65, sleeve 66, and ring 67. These spacing means are all held in the desired position on the stub 62 by means of a threaded nut 68. The outer race of each of the bearings 63 and 64 are supported in a bore 202 of a hub or support 69 by snap rings 70, and the hub 69 is secured on the side frame 71 by means of threaded fasteners or screws 72. The support or hub 69 has a cylindrical recess 73, and a cam 74, which has a cam groove 117 that receives a cam follower 116 of cam lever 58, is held in the recess 73 by means of threaded fasteners or screws 75. The stub or tail 62 has a smaller stub 78 which receives a control wheel 76 and is keyed thereto by a key 79. To hold the wheel 76 on the stub portion 78, a washer 80 and threaded fastener such as screw 81 are utilized. The control wheel 76 is in mesh engagement with a pinion 77 which is connected to drive means and rotates the device 13.

The rim 43 in addition to having mesh teeth for engaging the pinion 42 is provided with a peripheral tooth profile 82 which is in mesh engagement with a pinion 83. The pinion 83 is keyed to a setting or control axle 84 by a key 85 and is held in the desired axial position thereon by snap rings such as 86. The setting axle 84 is supported by a ball bearing 87 in a frame portion 88. Thus, with the member 44 held stationary, a rotation of the axle 84 will cause rotation of the rim gear 43 to shift the amount of eccentricity of the roller 14 with regard to the axle of the rotating member 44. The setting axle 84 is driven by means of the step-by-step motor 89 which is equipped with a position indicator 90. The step-by-step motor 89, moreover, is connected to the setting axle 84 by means of a coupling 91.

When the pinion 77 drives the gear 76, the member 44 is rotated on a first axis and the roller 14 is free to rotate on a second axis which is offset from the first axis. Thus, the roller 14 moves in an eccentric path around the first axis with the amount of eccentricity or offset being determined by the control screw 25. If the motor 89 drives the rim 43 so that it rotates with the member 44, the control screw 25 will not change the amount of offset between the first axis and second axis. However, if the speed of motor 89 is either increased or decreased, the ring 43 will rotate relatively with respect to the member 44 and thus rotate pinion 42 to change the amount of eccentricity of the second axis to the first axis.

As mentioned hereinbefore, the pivotable lever 62 has a sliding groove 54 which receives the sliding shoe 22 which is supported on the end 19 of the axle 15 of the roller 14. As best illustrated in FIGS. 3 and 5, the sliding groove 54 is formed by a pair of parallel extending bars 93 and 94 which are attached to the lever 52 by fastening means such as screws 92. In addition, the sliding groove 55, which receives the sliding shoe 56 is formed by a pair of clamping bars 95 and 96 (see FIGS. 3 and 6) which are attached to the pivotable lever 52 by threaded means such as screws 97.

As mentioned hereinbefore, the sliding support member 26 has as aperture 98 through which the end portion 19 is inserted and is supported by needle bearings 27 and 28 engaging the opposite parallel extending surfaces. Thus, any pivotable motion of the lever 52 causes the end 19 to be shifted in a direction extending at right angles to the axis of the control screw 25. The shifting is carried out by movement of the end 19 on the needle bearings 28 and 27.

The sliding support piece 26, as mentioned hereinabove, is guided during its movement by the screw 25 on the guiding rails 38 and 39. To accomplish this, the member 26 (see FIG. 3) is provided with sliding faces 102 and 103 which engage one surface of the guiding bars 38 and 39, respectively. Clamping bars 106 and 107 have sliding surfaces 104 and 105, respectively, which engage the opposite surface of the respective guiding bars 38 and 39. As illustrated, the clamping bars 106 and 107 are secured on the sliding member 26 by threaded means such as screws 108.

Figure 7:
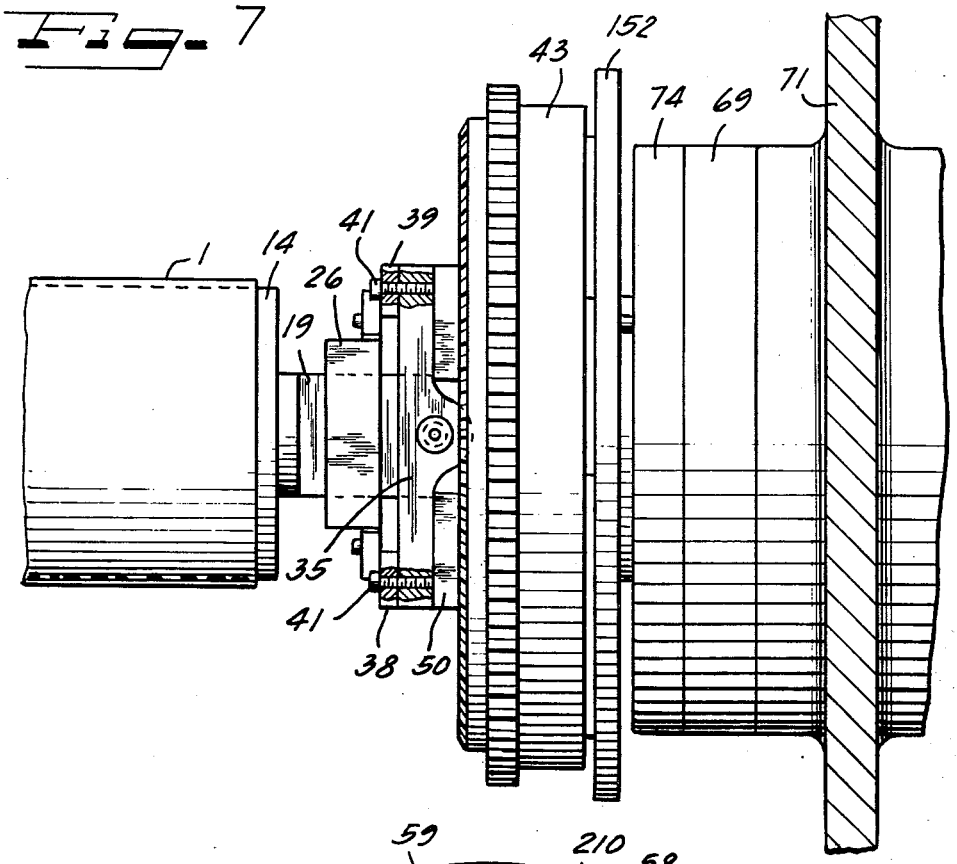
FIG. 7 is an elevational view with portions broken away for purposes of illustration taken along lines VII—VII of FIG. 2.

As mentioned hereinbefore, the supports 34 and 35 are attached to the guide rails 38 and 39. Thus, as illustrated in broken lines in FIG. 4, the guide rails 38 and 39 along with the supports 34 and 35 form a rectangular frame. Each of the supports 34 and 35 have a shape such as the support 35 (FIG. 7).

One side of the lever 52 has a sliding groove 55 receiving a sliding shoe 56 that is attached to a cam lever 58, which has the follower 116 (FIG. 2) that is received in the cam groove 117 in the cam member 74. To provide space to enable the lever 58 to pivot on its pivotable connection formed by the stud 59, a portion of the ring 47 in addition to the portion 115 of member 44 has also been cut out or removed. The follower 116, which is illustrated in broken lines in FIG. 6 rides in the cam groove 117 which has a slightly oval shape so that during each revolution of a member 44, the lever 58 is pivoted on its connection. This pivoting causes the lever 52 to pivot on the extension 51 and will cause a sliding movement of the end 19 in a direction extending perpendicular or at right angles to the axis of the control screw 25. Due to the fact that the pivoting is transferred by the engagement of the sliding shoe 22 in the sliding groove 54 which is provided on one face of the lever 52, it should be pointed out that the amount of shifting will be dependent on the radial distance of the axis of the axle 15 from the axis of the rotating member 44.

As best illustrated in FIGS. 2 and 6, a cam 152 is mounted with the ring 47 by the screws 49. This cam 152, which has a cut out portion 210 (FIG. 6) that is similar to portion 115, is engaged by a cam follower 151 (FIG. 2) which is supported on a lever or cam rod 150. The cam 152 has a profile so that during an angular portion of each revolution of the member 44, the lever 150 will be pivoted from one position to a second position.

Figure 8:
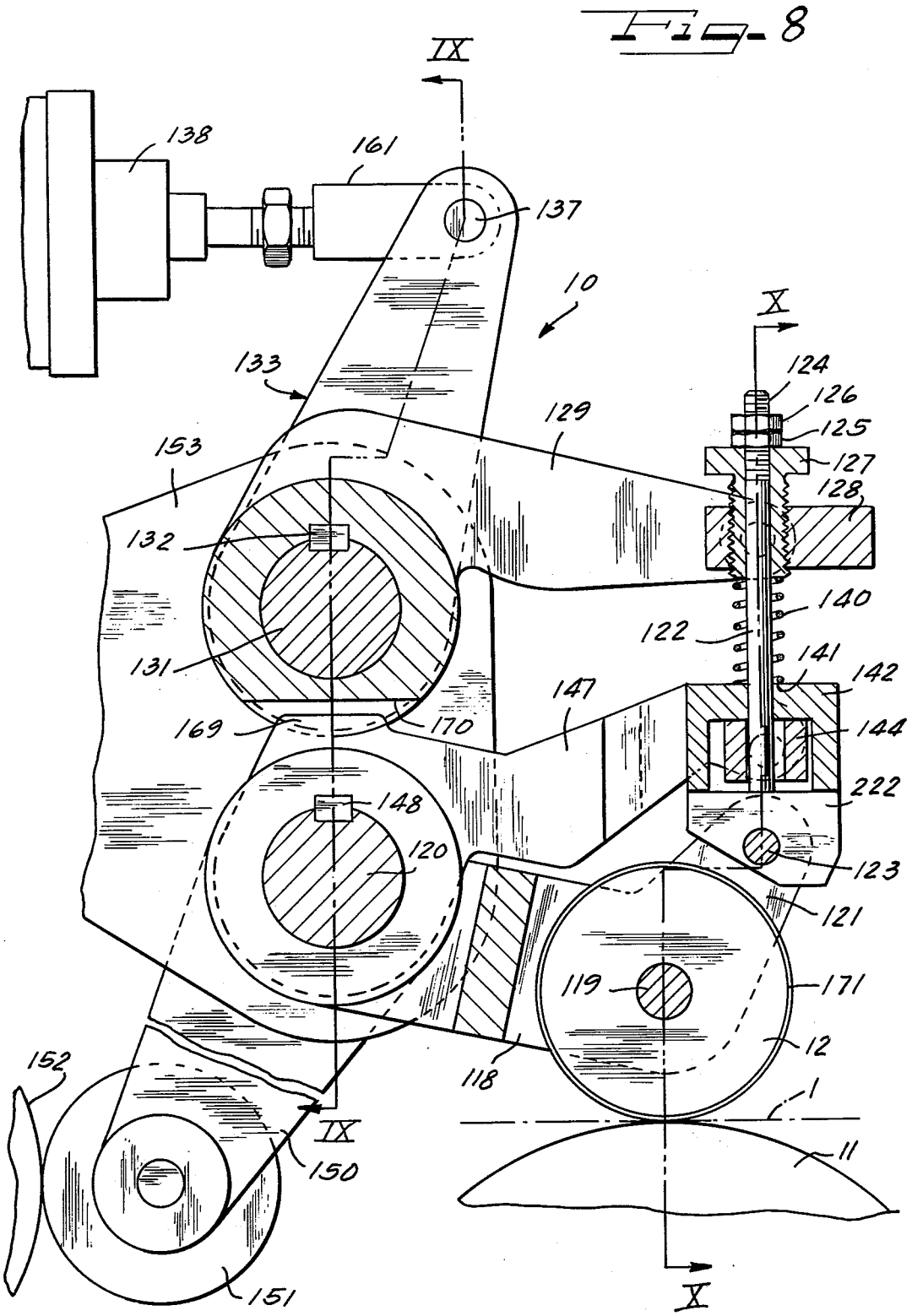
FIG. 8 is a partial cross-sectional view of an infeed appliance or device in accordance with the present invention.

A partial section of the infeed appliance or device 10 is illustrated in FIG. 8 and includes the lower driven roller 11 and a pressure roller 12, which has a circumferential rubber coating 171 and coacts to feed a web 1 which is illustrated in chain lines. The pressure roller 12 is mounted to rotate freely on an axle 119 carried by a bifurcated end of a lever 118 whose other bifurcated end has apertures 164 and 165 which receive a shaft 120. The bifurcated end of lever 118 which end supports the axle 119 has a pair of upstanding portions or ears 121 which support an axle 123 that rotatably supports an enlarged or wedged-shape end 222 of a setting or push rod 122. The rod 122 extends from the wedge-shaped end 222 through an aperture in a block 144, an aperture in a strap 142 and is slidably received in a sleeve 127 which is screwed or threadably received in a block 128. The opposite end 124 of the rod member 122 is threaded and receives a nut 125 along with a counternut or lock nut 126 which nuts enable adjusting the effective length of the rod.

Figure 9:
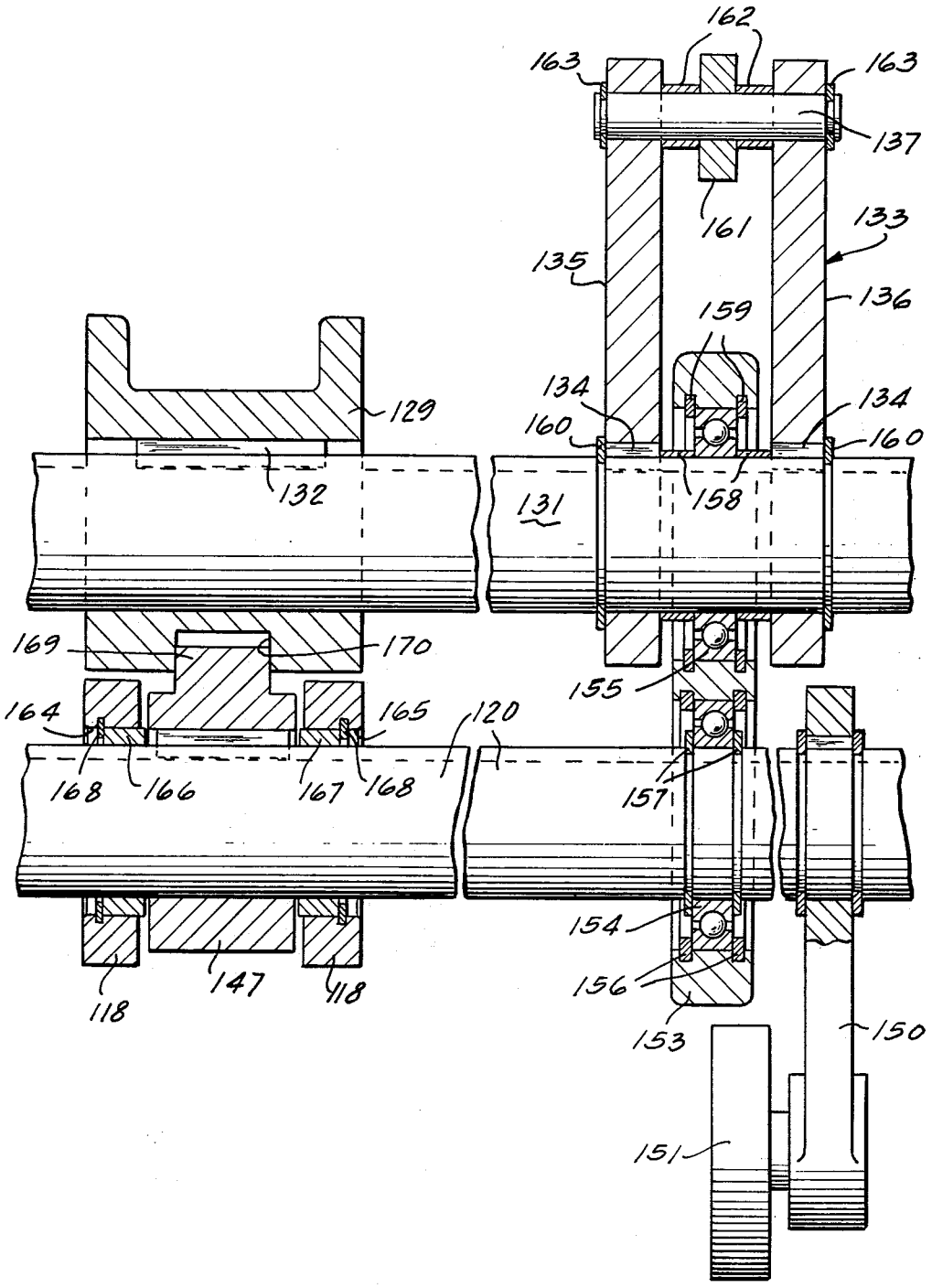
FIG. 9 is a cross-sectional view with portions in elevation for purposes of illustration taken along lines IX—IX of FIG. 8.
Figure 10:
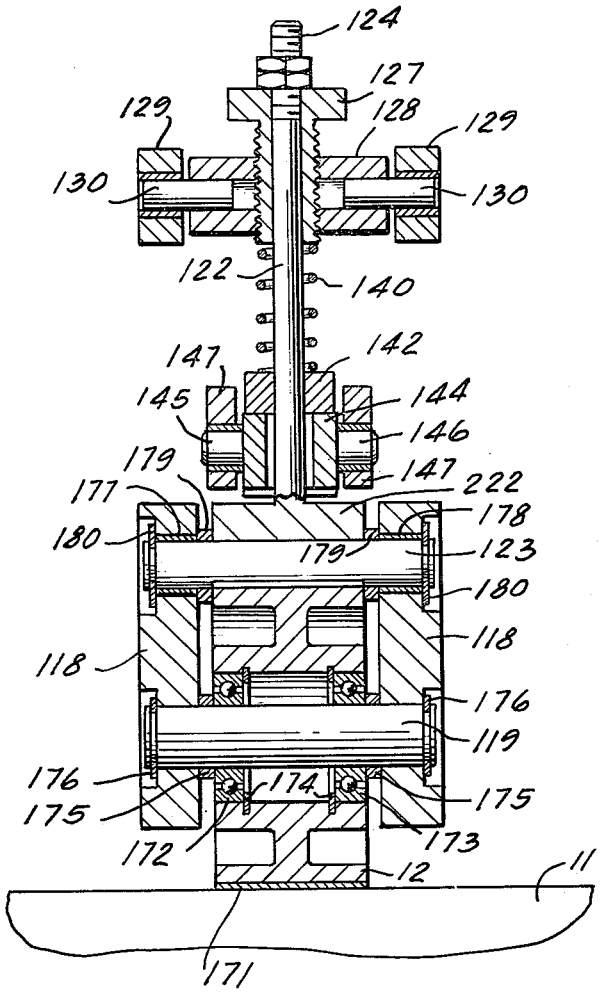
FIG. 10 is a cross-sectional view with portions in elevation for purposes of illustration taken along lines X—X of FIG. 8.

The block 128 which threadably receives the sleeve 127 is pivotably connected to a pair of levers 129 by cylindrical parts or pins 130 (FIG. 10). The pair of levers 129 (FIGS. 8 and 9) extend to a hub which is received on a shaft 131 and is interlocked to rotate with the shaft 131 by a key 132. A control lever 133, which consists of two arms 135 and 136 (FIG. 9) is also keyed on the shaft 131 by keys 134. The arms 135, 136 are interconnected together by means of an axle 137 and snap rings 163, 163. The axle 137 carries a head of a pull rod 161 that is spaced between the two arms 135 and 136 by spacing bushings 162, 162. The pull rod 161 (FIG. 8) is connected to a pneumatic piston 138 so that operation of the piston 138 will transmit angular or rotational movement to the shaft 131 through the lever 133. A rotation of the shaft 131 in a counterclockwise direction, as illustrated in FIG. 8, will cause a lifting of the pressure roll 12 from engagement with the driven roller 11 and thus will neutralize the force acting on the web 1.

The setting screw or sleeve 127 acts on a spring 140 which is telescopically received around the pin portion of the setting rod 122. The opposite end or face 141 of the spring 140 acts on the strap 142 to transfer the pressure of the spring 140 to the pressure roll 12. As illustrated, the strap 142 partially surrounds the block 144 which is supported by two cylindrical parts or pins 145 and 146 (FIG. 10) which are received in the forked end portions of 147 which has a hub portion that is received on the shaft 120 and keyed thereto by a key 148 (FIG. 8). Cam lever 150 as best illustrated in FIG. 9 is also keyed onto the shaft 120.

As best illustrated in FIG. 9, a support 153 of the frame of the device supports each of the shafts 120 and 131 which are free to rotate due to ball bearings 154 and 155. The ball bearing 154 is held in the desired position by means of snap rings 156 and 157 whereas the ball bearing 155 is held in place by means of bushings 158 and snap rings 159. The arms 135 and 136 of the lever 133 are held from sidewise or axial movement along the shaft 131 by snap rings 160, 160. In order for the lever 118 to be free to pivot on shaft 120, the apertures 164 and 165 receive a bushing type bearing 166 and 167, respectively, and these bushings 166 and 167 engage the snap rings such as 168. The hub of the lever 129 is prevented from sidewise or axial movement on the shaft 131 by a salient or projection 169 provided on the lever 147 being engaged in the groove 170 of the hub of the lever 129.

FIG. 10 best shows the manner in which the setting rod 122 and the pressure roller 12 are mounted on the lever 118. Pressure roller 12 is mounted for rotation on the axle 119 by a pair of ball bearings 172 and 173 which are received in the hub of the roller 12 and engage the axle 119. To hold the ball bearings in the desired spacial position, a pair of snap rings 174 coact with rings 175. To maintain the axle 119 in the lever 118, snap rings 176 are provided.

The enlarged end 222 of the setting rod 122 is received on the axle 123 which is carried in the ears 121 of the lever 118 by bearings 177 and 178. The sidewise position of this enlarged end of the setting rod 122 is determined by rings 179 and the axle is interlocked to prevent axial movement by a pair of snap rings 180.

As can be seen from FIGS, 8, 9 and 10, the pressure roll 12 applies a pressure on the web 1 as it passes between the roll 12 and roller 11. This amount of pressure is dependent on the spring force of spring 140 and can be adjusted by the threaded sleeve or nut 127. Actuation of the cylinder 138 to rotate the shaft 131 in a counterclockwise direction will cause a lifting of the pressure roll from engagement with the web 1.

As illustrated in FIG. 8, the force of the spring 140 is transmitted by strap 142 to urge the pressure roll 12 toward the driven roller 11. When the follower 151 engages a high point on the cam 152, the shaft 120 is rotated in a counterclockwise direction so that the block 144 forces the strap 142 against the spring pressure of spring 140 and out of engagement with the enlarged end 222 of the control rod 122. As the strap 142 is lifted out of engagement with the enlarged end of the control or setting rod 122, the force of the spring 140 is no longer being transferred to the pressure roll 12 so that the frictional engagement imparting motion to the web 1 is neutralized.

Since the platen press 2 is a machine which necessitates a standstill of the web as the pair of platens **2*a* and 2*b* perform a die cutting operation, the amount of web 1 accummulating during this predetermined period of the die cutting operation must be checked and controlled. To accomplish this task, the web 1 is supplied in a continuous way by pull unit 6 to the offset roller 14 around which it is partially wrapped. The offset roller 14 is mounted for rotation on a second axis which is defined by the shaft 15 which shaft and second axis can be shifted to various offset positions by use of the control screw 25. However, this radial offset or eccentricity of the second axis for the roller 14 relative to the axis of rotation of the members 44, which is the first axis, is insufficient to achieve a total absorption of the web 1 supplied by the pull unit 6 during a lapsed period of time corresponding to the time necessary for the die cutting operation to be accomplished. Thus, the amount of offset of the roller 14 is corrected either negatively or positively by means of the cam lever 58 acting on the lever 52. The pivoting point of the cam lever 58 is on the rotating member 44 so that as the member 44 rotates relative to the cam member 74, the cam follower 116 in the groove 117 will impart a swinging or pivotable movement to the lever 52 which is also engaged with the axle 15 of roller 14 due to the sliding engagement between the shoe 22 and the sliding groove 54. This swinging motion will thus modify the circumferential and angular position of the axle 15 of the roller 14 during each rotation of the members 44 in such a way that the web contained between the pull unit 6 and the infeed appliance 10 is always subject to the same stress even if the amount of web furnished by the pull unit 6 is entirely absorbed by the shifting of the roller 14. The member 44 is also provided on its circumference with a cam 152 which imparts an altering motion on lever 150**.

The purpose of this motion is to modify the pressure between each pressure roll 12 and the lower driven roll 11 of the infeed appliance 10 dependent on whether the web 1 is at a standstill or being shifted between the platens 2a and 2b of the press 2.

One of the advantages obtained by the use of this device is that it is no longer necessary to use an independent braking appliance to stop the web during the die cutting operation. In addition, the portion of the web 1 situated between the platens 2a and 2b of the press 2 is maintained under ideal tension condition, and a guaranteed high precision for the proper length of the portion of the web to be introduced between the platens 2a and 2b of the press 2 can be obtained. Finally, the present invention enables maintaining a practically steady web tension on the portion of the web which is between the pull unit 6 and the introducing appliance or infeed device 10.

Although various minor modifications may be suggested by those versed in the art, it should be understood that I wish to employ within the scope of the patent granted hereon, all such modifications as reasonably and properly come within the scope of my contribution to the art.

I claim:

1. In a process of permanently controlling the movement of a web of material being continuously supplied at a fixed rate of speed from a web feeding means to a machine which operates sequentially on portions of the web with each portion being at a standstill while being operated by the machine, said process comprising feeding the web from the feeding means around a circumferential portion of a roller of a web take-up means and then to the machine, said web take-up means having a pair of members mounted for rotation on a first axis and supporting the roller for rotation on a second axis offset from the first axis so that during one revolution of the take-up means, the length of the path of the web between the feeding means and the machine is continuously changing, the improvements comprising changing the angular position of the second axis of the roller relative to the first axis during each rotation of the take-up means and controlling the rate of change of the angular position in response to the amount of eccentricity of the second axis to the first axis so that the portion of the web within the machine is at a full standstill for a predetermined period which is required for the machine to operate on the portion due to the eccentric movement of the roller absorbing the total length of the web being supplied from the web feeding means during the predetermined period.

2. An apparatus for permanently controlling the movement of a web of material being continuously supplied to a machine which operates sequentially on portions of the web with each portion being at a standstill while being operated on by the machine, said apparatus including means for feeding the web at a continuous rate of feed including means for pulling and introducing the web of material, and a web take-up means for engaging the web of material, said web take-up means having a pair of members mounted in a pair of spaced side frame members for rotation on a first axis, a roller engaging a portion of the web, and means for mounting the roller in said pair of members for rotation on a second axis offset from the first axis, said means for mounting including a control screw for varying the amount of offset of the second axis from the first axis, the improvements comprising means for equilibrating the weight of said roller, and said means for mounting including means for varying the angular position of the second axis of the roller during rotation of said pair of members on the first axis, said means for varying changing the angular position at a rate dependent on the amount of offset between the first and second axis so that the portion of the web within the machine is at a standstill for a predetermined period of time which is required for the machine to operate on the portion due to the eccentric movement of the roller absorbing the total length of the web being supplied from the web feeding means during the predetermined period.

3. An apparatus according to claim 2, wherein means for equilibrating comprises a counterweight symmetrically mounted on the control screw relative to the roller, said control screw shifting the counterweight symmetrically as the amount of offset of the second axis of the roller to the first axis is varied.

4. An apparatus according to claim 2, wherein the means for varying the angular position includes a pivotable support mounted in each pair of members and engaging a respective end of the roller, a cam groove provided on each of the pair of side frames, and a cam lever having a follower riding in each cam groove and connected to the support.

5. An apparatus according to claim 4, wherein each of the pivotable supports is mounted to pivot on the first axis and said cam and lever pivot the support angularly on said first axis.

6. An apparatus according to claim 4, wherein the connection to the cam lever and the engagement of the end of the roller are disposed on opposite surfaces of the pivotable support.

7. An apparatus according to claim 4, wherein the engagement between the roller and the pivotable support comprises a coacting sliding shoe received in a sliding groove.

8. An apparatus according to claim 4, wherein the connection between the cam lever and the pivotable support comprises a coacting sliding shoe received in a sliding groove.

9. An apparatus according to claim 4, wherein each of the engagements between the end of the roller and the pivotable member and the cam lever and the respective pivotable member comprise a sliding groove disposed in the pivotable member receiving a sliding shoe provided on the end of the roller and on the cam lever.

10. An apparatus according to claim 9, wherein each of the sliding grooves for the connection to the cam lever and the sliding groove for the connection for the end of the roller are disposed on opposite surfaces of the pivotable support.

* * * * *